United States Patent [19]

Bengtsson

[11] Patent Number: 4,609,021

[45] Date of Patent: Sep. 2, 1986

[54] LOG DEBARKER

[76] Inventor: Uno Bengtsson, Thims väg 10, S-665 00 Kil, Sweden

[21] Appl. No.: 666,627

[22] PCT Filed: Feb. 7, 1984

[86] PCT No.: PCT/SE84/00035

§ 371 Date: Oct. 4, 1984

§ 102(e) Date: Oct. 4, 1984

[87] PCT Pub. No.: WO84/03062

PCT Pub. Date: Aug. 16, 1984

[30] Foreign Application Priority Data

Feb. 9, 1983 [SE] Sweden ..... 8300668

[51] Int. Cl.[4] ..... B27L 3/00

[52] U.S. Cl. ..... 144/208 D; 144/340

[58] Field of Search ..... 144/208 R, 208 D, 340

[56] References Cited

U.S. PATENT DOCUMENTS 2,453,947 11/1948 Swift ..... 144/208 D
2,463,084 3/1949 Bukowsky ..... 144/208 D
2,542,371 2/1951 Swift et al. ..... 144/208 D

FOREIGN PATENT DOCUMENTS 527964 7/1956 Canada ..... 144/208 D

*Primary Examiner*—W. D. Bray

[57] ABSTRACT

Barking arrangement for logs having nozzles (55) through which water at high pressure is sprayed onto the logs. Transport arrangements are provided to carry the log along a track (16) through the barking arrangement. The arrangement comprises a first assembly (21) capable of rotating around the track having an annular water housing (28) so arranged as to contain a co-rotating water ring during rotation, and a second assembly (22) capable of rotating and bearing at least one pitot tube (60). The pitot tube is intended to run with an opening (61) at the front facing in a direction of rotation opposite to that of the water ring, and is connected via a channel (48) to one of the nozzles (55). As the two assemblies rotate in opposite directions, water will be forced from the water ring and into the opening (61) of the pitot tube (60) through the channel (48) and out through the nozzle (55) in a jet. This is directed at the log (6) which is being fed along the track and which is situated on the track (16) and thus at the center of rotation.

4 Claims, 4 Drawing Figures

LOG DEBARKER

TECHNICAL FIELD

The present invention relates to a log barker or debarker which operates with jets of water.

BACKGROUND

Previously disclosed are de-barking arrangements for logs in which the barking operation is performed with the help of one or more jets of pressurized water. A considerable water pressure is needed if the desired barking effect is to be achieved. In these previously disclosed arrangements use has been made for this purpose of some form of hydraulic pump by means of which the water was pumped through pipes to one or more nozzles from which jets of water were directed onto the object from which it was wished to remove the bark.

TECHNICAL PROBLEM

Considerable losses have been found to occur in a barking arrangement of this construction, as the result of which very high power was required for the pumping operation if an acceptable barking result was to be achieved within a reasonable time. Furthermore, an arrangement of this kind has also been found to be associated with high assembly costs, since it consists of a hydraulic pump, separate assemblies for the spraying and handling of the logs, and equipment to connect together these two parts.

THE SOLUTION

The application of the present invention has resulted in a barking arrangement which operates with water jets, in which the necessary hydraulic pump has been integrated with the spraying and handling equipment for the logs, thereby achieving the smallest possible losses in the production of the pressurized water.

ADVANTAGES

The present invention makes it possible to simplify the arrangement in relation to previously disclosed barking arrangements by being able to produce the pressurized water directly inside the barking arrangement.

BRIEF DESCRIPTION OF THE DRAWINGS

Illustrated in the accompanying drawings is an embodiment of the invention.

BEST MODE OF CARRYING OUT THE INVENTION

Figure 1:
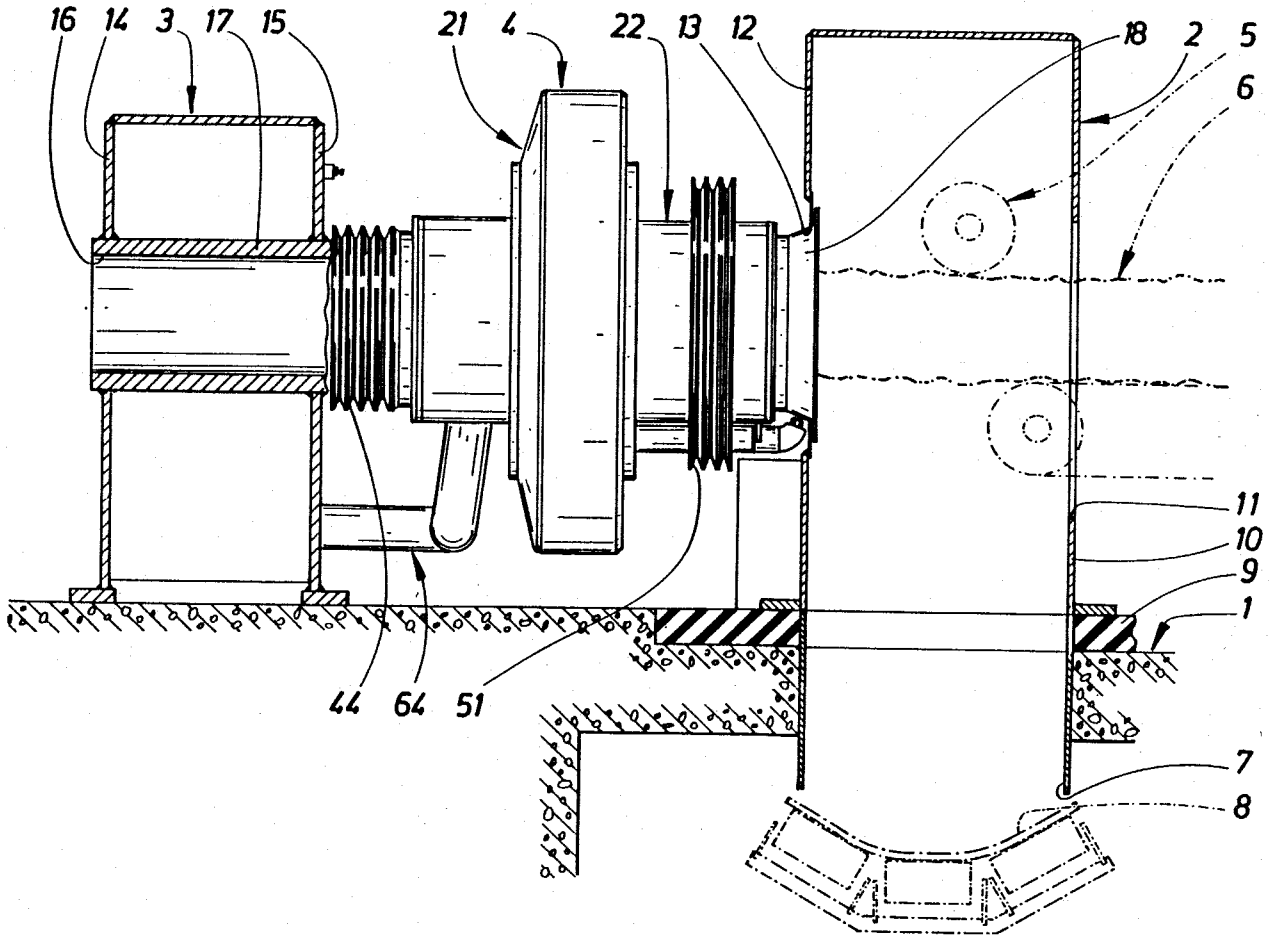
FIG. 1 shows a side view of a barking arrangement in accordance with the invention.

Attached to a base 1 as shown in FIG. 1 are on the one hand an input housing 2 and on the other hand a frame 3 supporting the mechanical equipment of the barking arrangement, for which the reference designation 4 is used. The input housing 2 is connected to transport means 5 for the logs 6 which are to be fed into the barking arrangement. The transport means 5 may be of conventional type and will not, therefore, be described in any greater detail here. They must, however, be designed to feed the logs 6 from which the bark is to be removed one after the other from an input channel. The transport means 5 shall be of the so-called self-centering type and shall thus feed the logs 6 into such a position that the centre-line of the different logs will lie in essentially the same position in relation to the barking arrangement irrespective of the size of the logs. Previously disclosed transport means of this kind operate with chains moving horizontally for the purpose of transporting the logs, said chains being shown in FIG. 1 to be both superjacent and subjacent chains which are so arranged as to centralize the logs in relation to each other, either with the help of a system of links or by the positive positioning of the logs under the control of an assembly which measures the thickness of the logs.

The bark which has been removed will be ejected from inside the input housing and is able to fall through a lower opening 7 in the housing 2 and down onto a conveyor belt 8 so arranged as to carry the bark to a dump. Such arrangements, too, have been previously disclosed and do not, therefore, require more detailed description. As may be appreciated from FIG. 1, the housing 2 projects through the base 1 so as to permit the aforementioned connection with the conveyor belt 8 to be achieved. The housing 2 is supported by the base 1 by means of a shock-absorbing rubber cushion 9 in order to prevent vibrations from the housing being transmitted to the base.

For the purpose of feeding the logs 6 an opening 11 is provided in a front wall 10 of the housing 2, and in a rear wall 12 is a second opening 13 into which the mechanical part 4 of the barking arrangement extends for the purpose of receiving the logs. The chamber thus formed between the walls 10 and 12 contains the lower opening 7.

The frame 3 is constructed in the form of a box with a front wall 15 and a rear wall 14, through which walls extends a stationary drum 17 constituting the fixed part of the mechanical part 4 and thus being supported by the frame. Drum 17 has a passage 16 therethrough. The frame 3 is also evident in FIG. 2, which also shows parts of the rear wall 12 of the input housing 2. It is also clear from the Figure how the drum 17 extends out of the housing 3.

Figure 2:
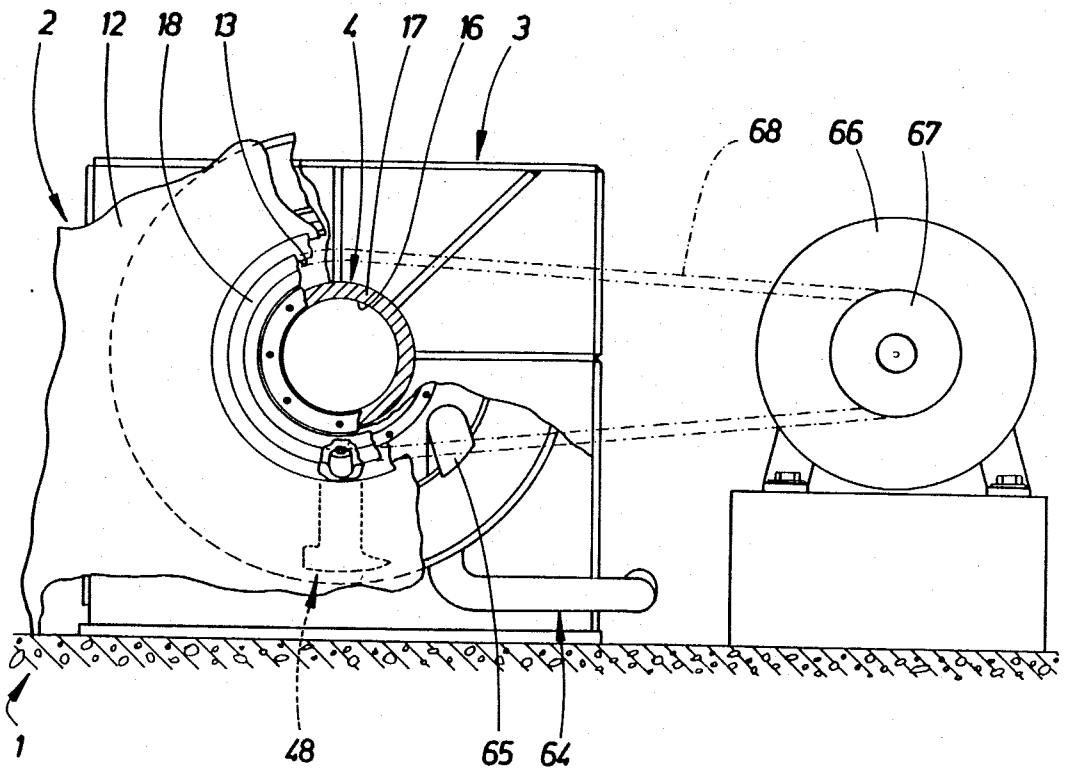
FIG. 2 shows a partially sectioned front view of the arrangement in accordance with the invention.
Figure 3:
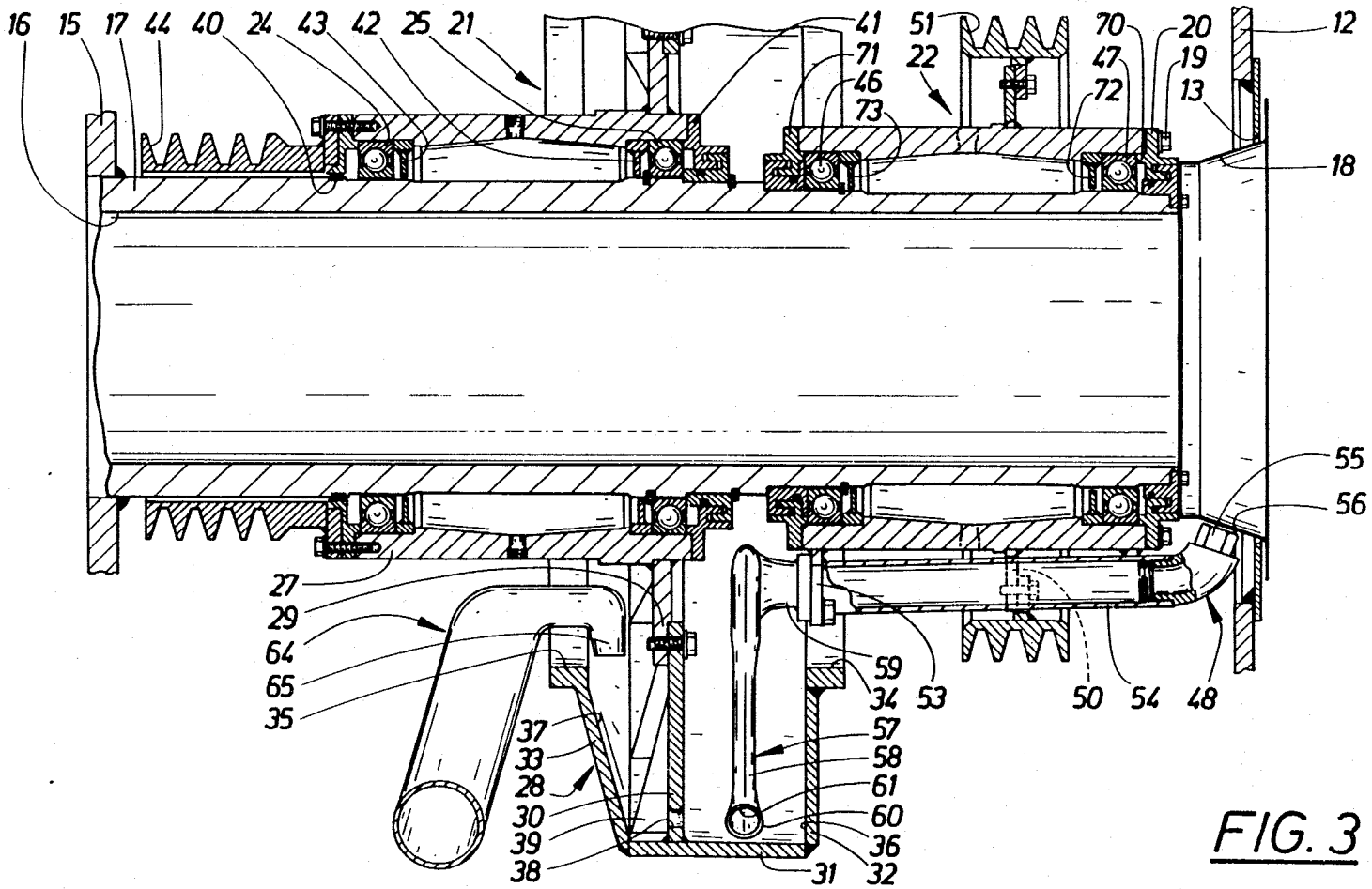
FIG. 3 shows a central section through the main part of the barking arrangement.

FIG. 3 shows how the drum 17 extends out of the wall 15 of the frame 3 and terminates at its outer end in a funnel-shaped collar 18 which extends into the opening 13 in the rear wall 12 of the input housing 2. This state of affairs is also clear from FIG. 2. The outside of the drum 17 has seats for the bearings and sealing rings for two assemblies capable of rotating about the stationary drum 17, referred to below as the water supply assembly 21 and the water outlet assembly 22. The collar 18 is not attached directly to the drum 17, but rather to a ring 20 which is connected by means of screws 19 to the rotating assembly 22.

The water supply assembly 21 is thus supported by two deep-groove bearings 24 and 25 and consists of a tubular inner part 27 and an annular water housing 28. The water housing 28 is supported by a flange 29 on the inner part 27 via an intermediate wall 30. The intermediate wall 30 is enclosed within a tubular jacket 31 from which extend inwards towards the center a front wall 32 and a rear wall 33. Both walls have a central opening 34 and 35 respectively, each of which is adjacent to an annular supporting column. The water housing 28 thus forms two annular chambers 36 and 37 respectively, of which the chamber 37 is referred to below as the inlet chamber and the chamber 36 as the outlet chamber. These two chambers are connected together via holes 38 in the intermediate wall 30. Between the holes 38 are blades 39.

The water supply assembly 21 has in addition to the components already described, a V-belt pulley 44 which is screwed tightly to the inner part 27 and a number of sealing arrangements; a labyrinth seal 41, a rubber seal 40 and two diaphragm seals 42 and 43 are so arranged as to form enclosed spaces for the bearings 24 and 25.

The water outlet assembly 22 itself has two bearings 46 and 47 on the bearing seats on the drum 17, said bearings supporting a drum-shaped inner part 49 with a flange 50, which in turn supports not only a V-belt pulley 51 but also a pressurized water pipe 48 (alternatively, a number of pressurized water pipes may be provided, preferably arranged at an identical angular distance in relation to each other).

The pressurized water pipe 48 has an axially arranged part 54 which is terminated towards the input end of the barking arrangement by a nozzle 55 facing essentially radially inwards towards the center of the drum 17, said nozzle being situated directly in line with a hole 56 in the conical collar 18.

The pressurized water pipe 48 has a section 57 of pipe having a part 58 running radially and connected by means of an internal connector 59 to the pipe 54. The part 58 ends outwardly in a head which constitutes a pitot tube 60.

Figure 4:
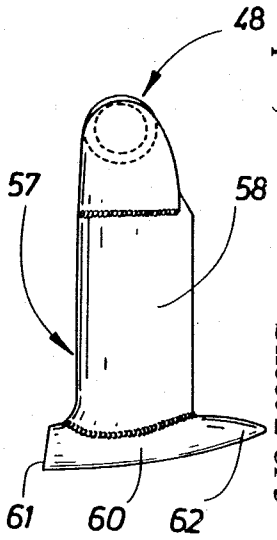
FIG. 4 shows a detail of FIG. 3.

The pitot tube 60 and the part 58 are also shown in FIG. 4, where they are viewed in the axial sense. As may be appreciated from FIG. 4, the pitot tube has one end, this being its front end, with an opening 61 and another end, this being its rear end, with a droplet-shaped tip 62. The cross-section of the part 58 is droplet-shaped, with the tapering part facing in the same direction as the tip 62, so that the pipe section 57 will have the lowest possible resistance when it moves in water with the opening 61 furthest to the front.

The water outlet assembly 22 also has seals 70–73.

A pipe 64 is provided for the purpose of supplying water to the water supply assembly 21, said pipe having an open end 65 situated inside the chamber 37.

The intention is that the water outlet assembly 22 shall rotate on the drum 17, so that the pressurized water pipe will move in such a way that the opening 61 of the pitot tube 60 will face forwards. At the same time the water supply assembly 21 is intended to rotate in the opposite direction. The water supply assembly 21 must rotate at a higher speed than the water outlet assembly. Appropriate speeds are 1500 r/min for the water supply assembly and 800 r/min for the water outlet assembly. Electric motors are provided for the purpose of driving both assemblies. These are connected by V-belts to the two belt pulleys 44 and 51. This is illustrated in FIG. 2, in which an electric motor 66 with a belt pulley 67 and also V-belts 68 are shown.

The operation of the barking arrangement requires the two assemblies to rotate, including the water outlet assembly 22 as has already been mentioned, so that the opening 61 of the pitot tube 60 will face towards the front, and with the water supply assembly 21 rotating in the opposite direction. Through the pipe 64 is supplied water, which flows out into the chamber 37 through the open end 65. The blades 39 carry this water along with them, and a water ring is formed through centrifugal force inside the chamber 37. The volume of the water ring is restricted by the opening 35, which will permit water to be released over its edge. Alternatively, the end 65 of the pipe 64 may be caused to be situated inside the edge of the opening 35, and at a restricted and appropriately set pressure in the pipe 64 this will enable the counter-pressure created by centrifugal force in the water ring to hold back the arriving flow, so that the water ring will be terminated inwardly more or less at the end 65 of the pipe 64.

The water carried around by the blades 39 as they rotate will be forced out by centrifugal force through the openings 38 and into the chamber 36. It is thus this flow of water which is to be replaced by the flow arriving through the pipe 64, so that the aforementioned water ring will always be present inside the chamber 37.

A water ring of which the internal diameter is restricted by the opening 34 will also be formed inside the chamber 36. This water ring will thus move together with the rapidly moving water housing 28, and the pitot tube 60 and parts of the radial component 57 will project into the water ring. Since the pitot tube together with the water outlet assembly 22 move in opposite direction to the water ring, the relative speed between the head of the pitot tube 60 and the water ring will be the sum of the peripheral speeds of the water ring and the pitot tube. The water will thus approach the front end of the tube 60 at high speed and will enter the opening 61 and will be forced to travel further by the radial component 58 through the connecting tube 59, via the axial component 54 and out through the nozzle 55. The jet of water formed in this way will flow radially inwards towards the center of the passage 16 in the drum 17 through the opening 56 in the conical collar 18.

Once a jet of pressurized water (or a number of jets in the case of several pitot tubes) has been generated in the manner described, the logs 6 can begin to be fed in by means of the transport means 5. The logs will move in sequence one after the other through the input housing 2 and into the conical collar 18 and then further through the passage 16 to the drum 17. In this way they will move past the jet of pressurized water rotating about the center of the passage 16 at the speed of rotation of the water outlet assembly 22.

As they pass through the arrangement, the circumference of the logs will be swept over in the form of a spiral by the jet of water, and since the rate of feed of the logs is relatively low in relation to the speed of rotation of the water outlet assembly, the circumference of the logs will be treated in its entirety by the jet of water. Because of the dynamic forces which arise in the course of the procedure outlined here, the pressure of the jet of water will be very high and will possess a considerable treatment capacity, with the result that the timber in the logs will be stripped of bark, gravel, ice and any other substances which may be present on the surface of the logs as they are fed in.

Since the pressurized water is produced directly inside the barking arrangement in very close proximity to the nozzle, the effect generated by the creation of the pressure is utilized in the best possible fashion. A further advantage is that the jet of water can also be made to orbit around the log, so that the latter need not be rotated. There is thus no need to provide any swivel couplings, which would be necessary in the case of an assembly having a fixed pump and a rotating nozzle.

I claim:

1. A log debarker comprising: transport means for transporting a log in longitudinal direction thereof along a predetermined track, at least one water nozzle positioned along said track for directing a water jet towards the log being transported along said track, a water supply channel, a pitot tube having an opening, said at least one nozzle being connected by said water supply channel to said pitot tube, said tube being situated in an annular water housing having a U-shaped radial cross-section, the open side of said cross-section being directed towards the center of the annular water housing, holding means for the pitot tube extending through said open side, supply means for water to the interior of said annular housing, first carrying means for rotating said nozzle in an orbit around said track in a first direction, second carrying means for the annular water housing for rotating the same concentrically to the orbit of rotation of the nozzle in a second direction opposite to said first direction, whereby upon rotation of said nozzle and said annular water housing by means of said first and second carrying means the pitot tube will rotate into the ring of water supplied to the interior of the annular water housing, to thereby force water into the opening of the pitot tube, through said channel, and out through said at least one nozzle in a jet directed at the log on the track in said orbit of rotation.

2. A log debarker according to claim 1, comprising a tubular drum along said track projecting with a free portion from a carrying frame of said first carrying means, said annular housing being supported on said free portion of said drum, with the nozzle extending from said first carrying means outside the end of said free portion.

3. A log debarker according to claim 1, comprising an interior wall dividing the interior of said annular water housing into two open spaces, said water supply means being connected to one of said two spaces and the pitot tube being situated in the other one of said two spaces.

4. A log debarker according to claim 2, comprising an interior wall dividing the interior of said annular water housing into two open spaces, said water supply means being connected to one of said two spaces and the pitot tube being situated in the other one of said two spaces.

* * * * *